US010780732B1

(12) United States Patent
Basinkewitz

(10) Patent No.: US 10,780,732 B1
(45) Date of Patent: Sep. 22, 2020

(54) INTERLOCKING SECTIONED ART SUBSURFACE

(71) Applicant: Jeffry Scott Basinkewitz, Denver, CO (US)

(72) Inventor: Jeffry Scott Basinkewitz, Denver, CO (US)

( * ) Notice: Subject to any disclaimer, the term of this patent is extended or adjusted under 35 U.S.C. 154(b) by 0 days.

(21) Appl. No.: 16/847,996

(22) Filed: Apr. 14, 2020

Related U.S. Application Data

(63) Continuation of application No. 15/876,105, filed on Jan. 19, 2018.

(60) Provisional application No. 62/866,107, filed on Jun. 25, 2019.

(51) Int. Cl.
*G09F 15/02* (2006.01)
*B44C 5/04* (2006.01)
*G09F 15/00* (2006.01)

(52) U.S. Cl.
CPC ..... *B44C 5/043* (2013.01); *B44C 5/0461* (2013.01); *G09F 15/0062* (2013.01); *G09F 15/02* (2013.01)

(58) Field of Classification Search
CPC ... B44C 5/043; B44C 5/0461; G09F 15/0062; G09F 15/02
USPC ..... 206/442, 83.5; 446/71, 86, 119; 273/155, 153 S
See application file for complete search history.

(56) References Cited

U.S. PATENT DOCUMENTS 373,384 A * 11/1887 Works ..... A47G 1/0605 40/794
2,953,380 A * 9/1960 Hassenbach ..... A63F 9/10 273/157 R
4,483,535 A * 11/1984 LeCart ..... A63F 9/0803 273/153 S
4,890,839 A * 1/1990 Ayotte ..... A63F 9/1044 273/157 R
5,651,715 A * 7/1997 Shedelbower ..... A63F 9/088 273/155
5,924,692 A * 7/1999 Rosenberg ..... A63F 9/32 273/153 R
D804,194 S * 12/2017 Thams ..... D6/300
2005/0016096 A1* 1/2005 Wright, Jr. ..... B44C 5/0446 52/311.1
2011/0308124 A1* 12/2011 Polin ..... G09F 15/0012 40/729
2012/0017480 A1* 1/2012 Shtainhorn ..... A47G 1/0616 40/745

* cited by examiner

*Primary Examiner* — Cassandra Davis
(74) *Attorney, Agent, or Firm* — Plager Schack LLP; Mark H. Plager; Kara Verryt

(57) ABSTRACT

An interlocked sectioned art subsurface may include a plurality of removably interlocking panels making up the subsurface; a channel extending into an outer perimeter of the subsurface; and a security band, such as a tension spring, positioned within the channel and encircling the perimeter of the subsurface, the security band sized and positioned to secure the panels together. The plurality of panels may include a pair of exterior panels and, optionally, at least one interior panel, wherein the panels removably engage with one another via a tongue and groove system.

4 Claims, 3 Drawing Sheets

INTERLOCKING SECTIONED ART SUBSURFACE

RELATED APPLICATION

This application claims priority to provisional patent application U.S. Ser. No. 62/866,107 filed on Jun. 25, 2019 and claims priority to and is a continuation of non-provisional patent application U.S. Ser. No. 15/876,105 filed on Jan. 19, 2018, the entire contents of each of which is herein incorporated by reference.

BACKGROUND

The embodiments described herein relate generally to artwork and, more particularly, to an interlocking sectioned art subsurface.

Conventional subsurfaces for artwork are typically solid, non-componentized panels. The existing subsurfaces are also typically assembled using non-removable elements, such as adhesives, staples, and nails. This creates issues with warping, transporting, shipping costs, and sustainability. Specifically, if damaged, the surfaces are not usually repairable because of the permanence of the materials used for manufacture.

Moreover, conventional subsurfaces are typically not made from sustainable materials and are typically made with fasteners and adhesives that limit or prevent the ability to disassemble the panels if warping or damage occurs.

Therefore, what is needed is a subsurface for artwork, wherein the subsurface includes removably interlocking panels designed to remain engaged for a lengthy period of time while also being capable of being taken apart without damaging the work for transport, storage, repairs, or the like.

SUMMARY

Some embodiments of the present disclosure include an interlocked sectioned art subsurface. The subsurface may include a plurality of removably interlocking panels making up the subsurface; a channel extending into an outer perimeter of the subsurface; and a security band, such as a tension spring, positioned within the channel and encircling the perimeter of the subsurface, the security band sized and positioned to secure the panels together. The plurality of panels may include a pair of exterior panels and, optionally, at least one interior panel, wherein the panels removably engage with one another via a tongue and groove system.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a subsurface for artwork and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Interlocking Panels b. Security Band

The various elements of the present disclosure may be related in the following exemplary fashion. It is not intended to limit the scope or nature of the relationships between the various elements and the following examples are presented as illustrative examples only.

Figure 1:
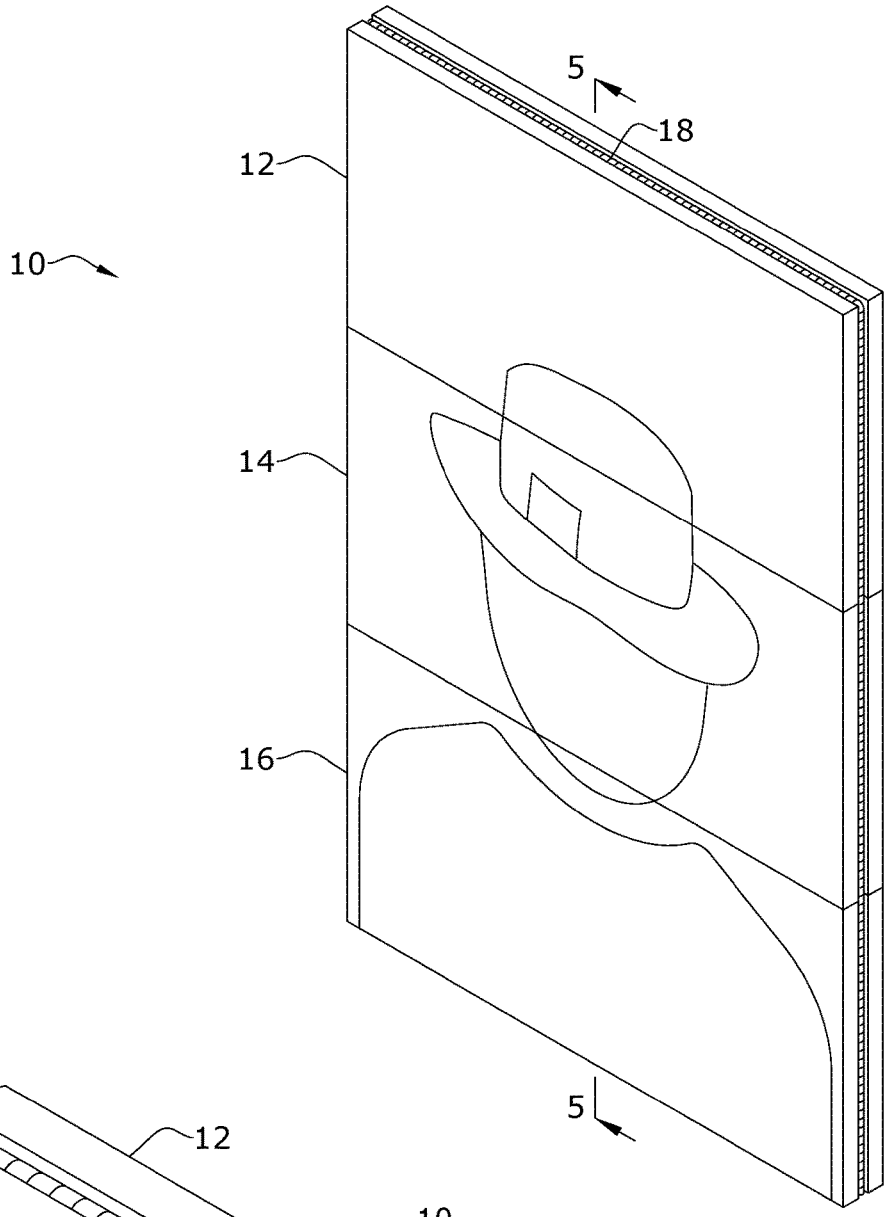
FIG. 1 is a perspective view of one embodiment of the present disclosure.
Figure 2:
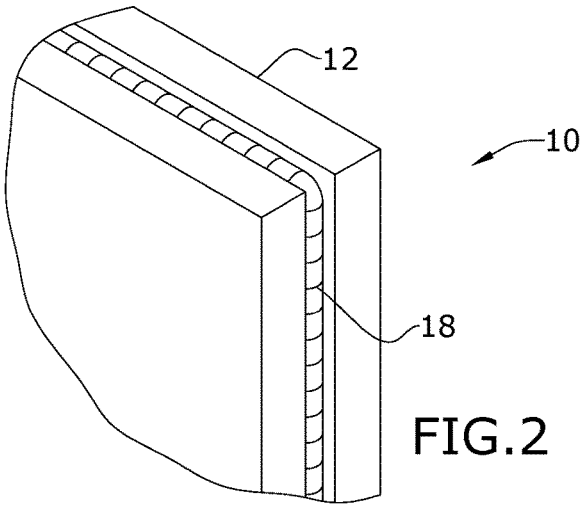
FIG. 2 is an enlarged perspective detail view of one embodiment of the present disclosure.
Figure 3:
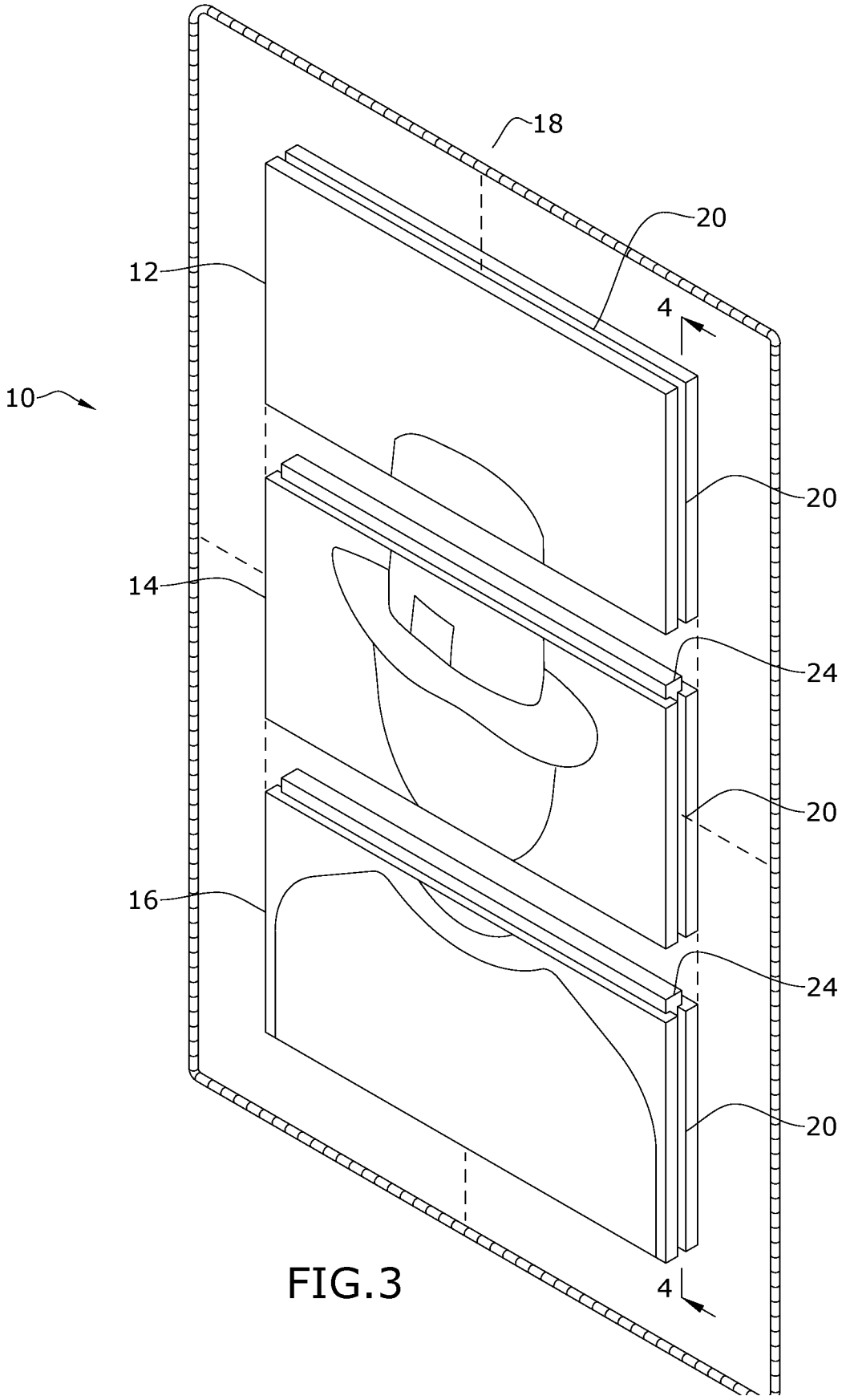
FIG. 3 is an exploded perspective view of one embodiment of the present disclosure.
Figure 4:
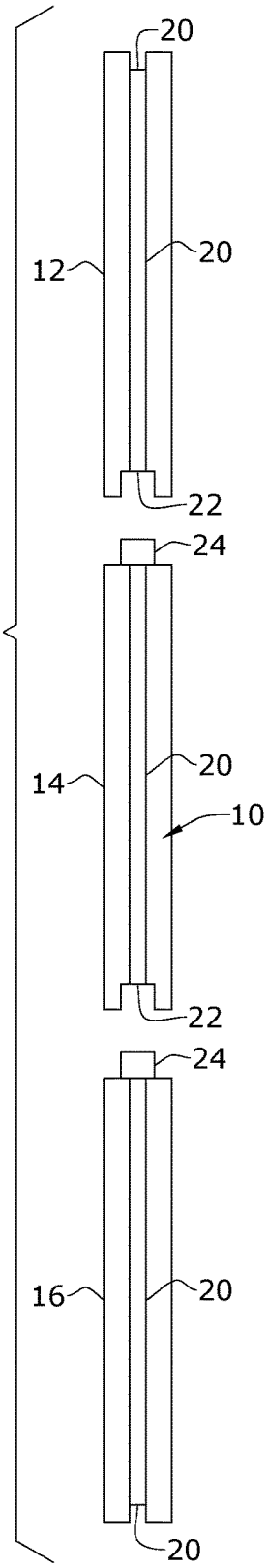
FIG. 4 is an elevation view taken along line 4-4 in FIG. 3.
Figure 5:
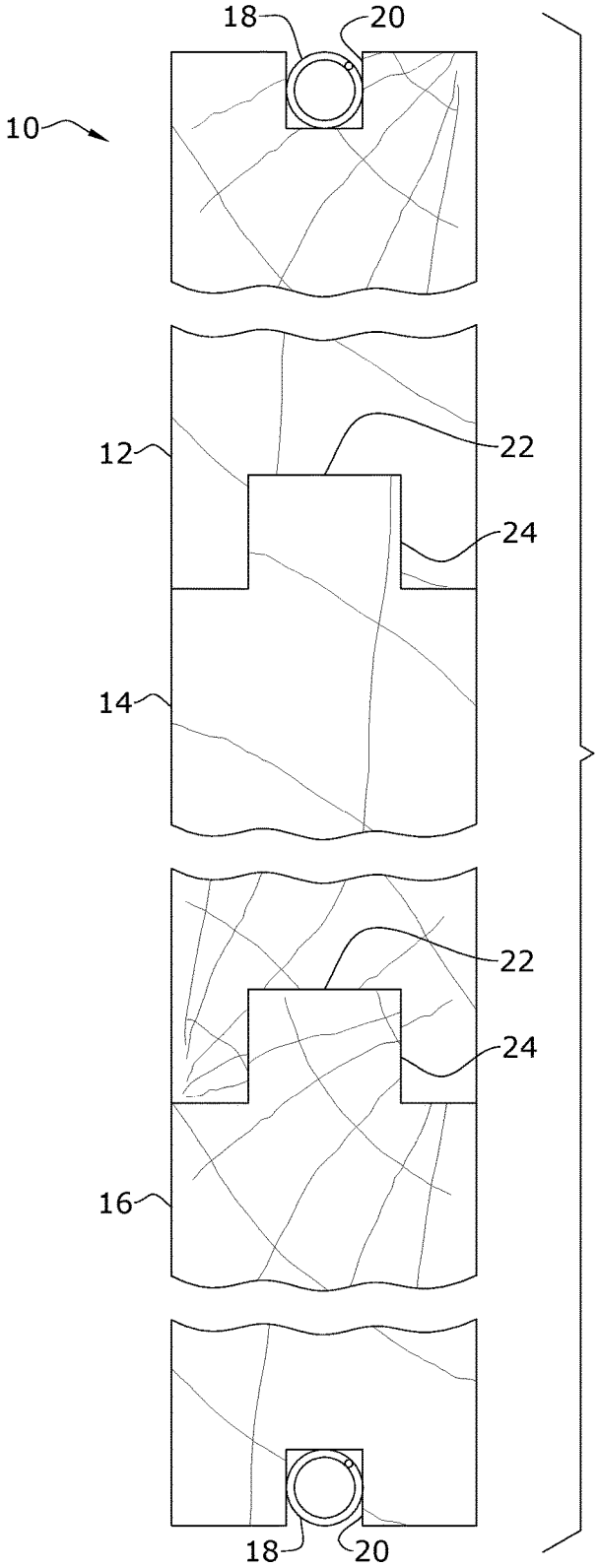
FIG. 5 is a section view taken along line 5-5 in FIG. 1.

By way of example, and referring to FIGS. 1-5, some embodiments of the invention include an interlocking sectioned art subsurface 10 comprising a plurality of removably interlocking panels, and a security band encircling an outer edge of the subsurface 10, the security band positioned and designed to secure the panels together.

As shown in the Figures, embodiments of the device may comprise a plurality of interlocking panels. For example, the device may comprise at least two interlocking panels—first panel 12 and second panel 16. However, in further embodiments, the device may further comprise at least one interior panel, such as third panel 14, positioned between the first panel 12 and the second panel 16. In yet further embodiments, the device may comprise a plurality of interior panels positioned between the first panel 12 and the second panel 16. The first panel 12 and the second panel 16 may also be referred to as exterior panels.

As shown in the Figures, each of the panels may interlock with adjacent panels via a tongue 24 and groove 22 mechanism, wherein an inner edge of the first panel 12 may comprise a groove 22 designed to engage with a tongue 24 extending from an inner edge of either an interior panel (i.e., third panel 14) or the second panel 16. Thus, the groove 22 may be sized to tightly accommodate the tongue 24 being positioned therein. While a tongue 24 and groove 22 system is described above and shown in the Figures, the use of other interlocking structures, such as the use of a splines, biscuit, or mortise and tenon system, is also envisioned.

As shown in the Figures, the outer edges of each panel (i.e., the edges designed to be the outer edges of an assembled subsurface 10) may comprise a band channel 20 extending along a length thereof, such that the assembled subsurface 10 includes a continuous band channel 20 extending along the perimeter thereof. The band channel 20 may be sized to accommodate a security band therein, wherein the security band may have a size shape, and material suitable for holding the panels together for a lengthened period of time. In other words, the security band may be capable of holding tension for a period of time, for example, at least about 30 to 50 years. Exemplary security bands include a tension spring 18, a rubber band, a cam buckle strap, and the like. In embodiments, the preferred band may comprise a tension spring 18. Using a tension spring 18 may allow the material to expand and contract while, at the same time, keeping the system intact without warping.

Due to the requisite tongue 24 or groove 22 and band channel 20, the subsurface 10 may comprise a variety of distinct panels. For example and as described above, the subsurface 10 may comprise a pair of exterior panels—first panel 12 and second panel 16. The first panel 12 may comprise three edges having the band channel 20 extending therein, while a fourth edge may comprise the groove 22. The second panel 16 may comprise three edges having the band channel extending therein, while a fourth edge may comprise the tongue 24. Interior panels (i.e., third panel 14), when included, may comprise two edges having the band channel 20 extending therein, third edge having the groove 22 extending therein, and the fourth edge comprising the tongue 24, wherein the edges with the band channel 20 may be parallel to one another, and the edge with the groove 22 may be parallel to the edge having the tongue 24.

The subsurface 10 of the present disclosure may comprise any desired materials. For example, the panels may be made of a sustainable material, such as beetle kill pine, or other wood, plastic, metal, or rigid material, as desired. In embodiments, the security band may also be made of a sustainable material, such as pure gum rubber. However, as mentioned above, other materials may be suitable, and the use of other materials is envisioned.

While the Figures show the subsurface 10 as being substantially rectangular in shape, the subsurface 10 is not limited to a particular overall shape, so long as the panels can interlock and the perimeter of the subsurface 10 includes a channel 20 for a security band (i.e., tension spring 18). Additionally, while the Figures show the panels having similar dimensions to one another, the panels are not limited to having the same or similar dimensions. For example, in some embodiments, some panels may be wider than others to accommodate a particular desired overall size of the subsurface 10.

To use the device of the present disclosure, an artist may receive the subsurface 10 in an unassembled configuration. The artist may then assemble the subsurface 10 and create his or her work of art. To then ship or otherwise transport the artwork, the subsurface 10 may be disassembled, which may provide for easier transport and lower shipping costs. When the subsurface 10 arrives at its desired location, it may be reassembled by easily interlocking the panels and placing the tension spring 10 in the channel 20 around the outer edge thereof. Because multiple panels are used rather than one large panel, the subsurface 10 of the present disclosure have a reduced likelihood of warping. Due to the ability to disassemble the subsurface, the subsurface 10 may also provide for easier repairs or replacements if any of the components are damaged. Lastly, the subsurface 10 may be easily put together without the use of permanent fasteners or adhesives.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. An interlocked sectioned art subsurface comprising:

a plurality of removably interlocking panels making up the subsurface, the plurality of removably interlocking panels comprising:

a first panel comprising an edge with a groove extending therein; and a second panel comprising an edge with a tongue extending outward therefrom, the tongue sized to engage with the groove;

a channel extending into an outer perimeter of the subsurface; and a security band positioned within the channel and encircling the perimeter of the subsurface, the security band sized and positioned to secure the panels together.

2. The interlocked sectioned art subsurface of claim 1, further comprising:

a third panel positioned between the first panel and the second panel, the third panel comprising:

a first edge with a tongue extending therefrom, the tongue of the third panel designed to engage with the groove in the first panel; and a second edge opposite the first edge, the second edge comprising a groove, wherein the tongue of the second panel is designed to engage with the groove of the third panel.

3. The interlocked sectioned art subsurface of claim 1, wherein the security band is a tension spring.

4. An interlocked sectioned art subsurface comprising:

a first panel comprising a plurality of first panel outer edges and a first panel inner edge, the first panel inner edge comprising a groove extending therein;

a second panel comprising a plurality of second panel outer edges and a second panel inner edge, the second panel inner edge comprising a tongue extending outward therefrom;

at least one interior panel removably positioned between the first panel and the second panel, the at least one interior panel comprising a plurality of interior panel outer edges, a first interior panel inner edge, and a second interior panel inner edge, wherein the first interior panel inner edge comprises a groove extending therein, and the second interior panel inner edge comprises a tongue extending outward therein;

a channel extending into the first panel outer edges, the second panel outer edges, and the interior panel outer edges, wherein when the panels are interlocked a subsurface with a continuous channel is formed along a perimeter of thereof; and a tension spring removably positioned within the continuous channel.

* * * * *